US005381929A

United States Patent [19]

Salz

[11] Patent Number: 5,381,929

[45] Date of Patent: Jan. 17, 1995

[54] LEVERAGED TUBE-WINDER WITH PASSIVE UNWINDING RESTRAINT

[76] Inventor: Robert B. Salz, 1646 Stanford Ave., Menlo Park, Calif. 94025

[21] Appl. No.: 101,583

[22] Filed: Aug. 3, 1993

[51] Int. Cl.[6] ..... B65D 35/32

[52] U.S. Cl. ..... 222/99

[58] Field of Search ..... 222/99-101

[56] References Cited

U.S. PATENT DOCUMENTS

| | | | |
|---|---|---|---|
| 951,132 | 3/1910 | Kinsey | 222/99 |
| 2,862,647 | 12/1958 | Dietz | 222/99 |
| 2,903,162 | 9/1959 | Regan | 222/99 |
| 3,085,716 | 4/1963 | Trattler | 222/100 X |
| 4,653,670 | 3/1987 | Kendrick | 222/99 |
| 5,014,879 | 5/1991 | Hill | 222/99 |

FOREIGN PATENT DOCUMENTS

| | | | |
|---|---|---|---|
| 664032 | 1/1952 | United Kingdom | 222/99 |

*Primary Examiner*—Kevin P. Shaver

*Attorney, Agent, or Firm*—William Green & Associates

[57] ABSTRACT

A combination tube-winder and dispenser for emptying the contents of a collapsible tube, flattening the empty portion of the tube and winding the empty flattened portion of the tube upon a portion of the device. The device is formed, from a single length of wire in which the base is a clasp portion having substantially parallel spaced apart members for holding, flattening, winding, and dispensing the contents of the tube and the upright portion is a lever disposed at an interior angle of less that 90 degrees relative to the clasp, which uses mechanical advantage to facilitate the winding function. The less-than-90-degrees interior angle permits the upper portion of the lever of the device to be positioned behind the tube and thus passively restrain the tube from unwinding. The device may be disengaged from and reattached to a partially wound tube without completely unwinding the tube.

7 Claims, 1 Drawing Sheet

LEVERAGED TUBE-WINDER WITH PASSIVE UNWINDING RESTRAINT

BACKGROUND OF THE INVENTION

1. Field of the Invention

This invention relates generally to devices for dispensing the contents of collapsible tubes, flattening the portion of the tube from which the contents have been dispensed and for winding the empty flattened portion of the tube upon a portion of the device and more particularly relates to a leveraged tube winder in which the winder also acts as a passive restraint to prevent the tube from spontaneously unwinding.

2. Brief Description of the Prior Art

The prior art discloses many devices for dispensing the contents of collapsible tubes.

These devices generally consist of a clasp as a means to engage and hold the bottom sealed end of the tube and an accompanying winder configuration to revolve the clasp, thereby winding the tube on to the clasp and forcing the tube contents toward the dispenser end of the tube.

Clasp sections are generally of three basic types, rigid with both ends closed, semi-rigid with one open end facing the accompanying winder and semi-rigid with the open end facing 180 degrees away from the accompanying winder.

SUMMARY OF THE INVENTION

This invention provides an improved device for dispensing toothpaste and other paste-like, grease-like viscous substances from collapsible tube dispensers. The device is a one-piece semi-rigid wire clasp and winder, with the clasp having an open end facing toward the winder. The device is fitted upon the flat bottom sealed end of such tubes by inserting the bottom of the tube into the clasp. The lever portion of the device is then moved in a clockwise or counter-clockwise direction causing the empty portion of the tube to wind up toward the dispensing end of the tube in a uniform manner. The device provides for controlled emission of the tube contents and minimizes spillage and excess emission.

The device of this invention is distinguished from the devices disclosed in the parent applications of this application by having the angle between the winder and the base less than 90 degrees rather than L-shaped.

Although many devices for dispensing contents from collapsible tubes have been disclosed, the combination of a simple winding device in combination with simple means for preventing the tube from unwinding has been elusive. It is the primary objective of this invention to provide a one-piece device that acts both as a winder and a passive unwinding restraint.

The prior art includes a device with locking means to prevent a partially wound tube from unwinding. However such device requires that the clasp portion of the device be slidably displaced along the axis of the clasp in order to unlock the device. Further, the clasp portion of the device must be elongated to allow for the lateral displacement of the tube along the clasp axis. In addition such a device does not permit unwinding a partially wound tube. It is an object of this invention to provide a device that may be restrained from unwinding without requiring any manipulation of the tube within the clasp and which will permit a partially wound tube to be removed without any such manipulation.

The ability to engage or disengage the device from a partially wound tube also allows it to be transferred to another partially wound tube which is a desirable feature when dispensing sealing and caulking compounds, epoxy, adhesives, lubricants, medications, and artists' paints. This feature is of particular importance to commercial users and to artists, where it is common to switch uses among a number of tubes containing different materials or different paints. This feature is also a convenience for a person sharing a device with other persons for use on more than one tube.

In some prior art devices, the device is either permanently affixed to the tube and must be discarded after one use or is difficult to remove. It is a further objective of this invention to provide a device which is reusable and which is easily removable.

The major manufacturers of toothpaste and other products have recently introduced a new tube generically described as a "stand-up" tube. These tubes are made from a heavy gage plastic which tends to spontaneously unwind after having been wound. It is another objective of this invention to provide a device which resists such unwinding by passive restraint, yet permits disengagement and reattachment of the device without unwinding the tube.

DETAILED DESCRIPTION OF THE INVENTION

Figure 1:
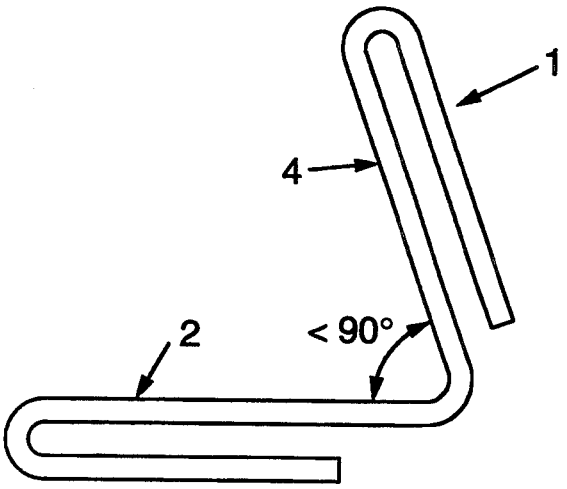
FIG. 1 is the preferred embodiment of a device in accordance with this invention.

A preferred embodiment of this invention is shown in FIG. 1, which shows a tube winder in accordance with the invention generally designated as 1. A length of wire rod has been bent to form a double winder device. The device comprises two U-shaped clasps 2 and 4 formed by spaced apart parallel legs and each having a free end. Clasps 2 and 4 are of unequal length. Thus the device is sized for two ranges of tube widths. When clasp 2 is affixed to a tube, clasp 4 acts as a winding lever. Conversely, when clasp 4 is affixed to a tube, clasp 2 acts as a winding lever. The parallel legs of each clasp are approximately ¼" wider than the width of the bottom sealed end of a collapsible tube and are spaced apart a distance sufficient to permit insertion of the bottom of such tube.

The angle at the junction of Clasps 2 and 4 is selected to be less than 90 degrees. This modification has the effect of permitting the upper-most portion of whichever clasp is functioning as a lever to turn as a ratchet and when at rest to be positioned behind the tube relative to the position of the remainder of said clasp. This causes the filled portion of the tube to passively restrain the clasp which is functioning as a lever and to prevent the tube from unwinding when not in use.

The clasps are disposed such that when the clasp is functioning as a clasp its open or free end is proximate the clasp which is functioning as a winder. The positioning of the free end proximate the clasp permits a partially wound tube to be inserted through the side of the clasp between the open end of the clasp and the clasp functioning as a lever. This permits the engagement or disengagement of the device to or from a partially wound tube without having to unwind the tube. An unwound tube may be inserted either through the front of the clasp or through the side of the clasp.

Figure 2:
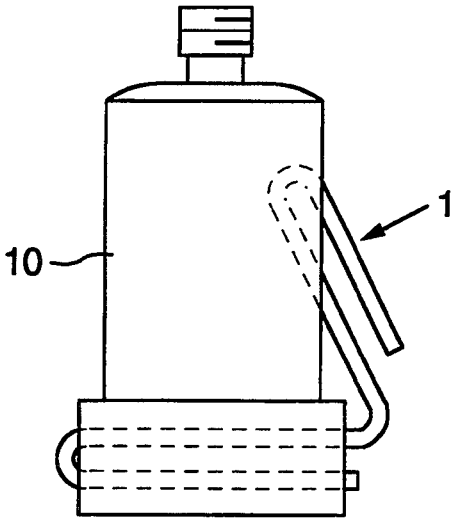
FIG. 2 is a perspective view of the embodiment of FIG. 1 affixed to a partially wound tube and in a passively restrained position.

FIG. 2 shows the embodiment of FIG. 1 engaged to a bottom sealed tube 10. The industry practice relating to collapsible tubes is to leave a void space inside the tube adjacent to the bottom sealed end. In the practice of this invention, the void areas permit the user to manually flatten the areas of tube 10 near the bottom sealed end. The flattened area of tubes 10 is then inserted between the parallel legs of either clasp 2 or 4. The other clasp acts as a lever and is then turned, in either a clockwise or counter-clockwise direction causing the sealed end of tubes 10 to start winding onto the clasp through which it was inserted and forcing the contents of the tube toward the dispenser end.

Figure 3:
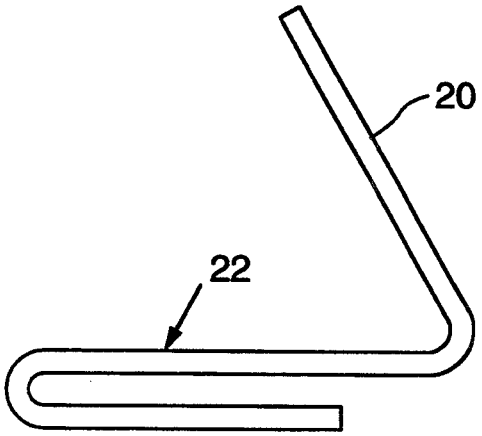
FIG. 3 is a single winder embodiment of the invention.

FIG. 3 is a single winder version of the device in which lever 20 is a simple rod disposed at an angle of less than 90 degrees relative to clasp 22.

Figure 4:
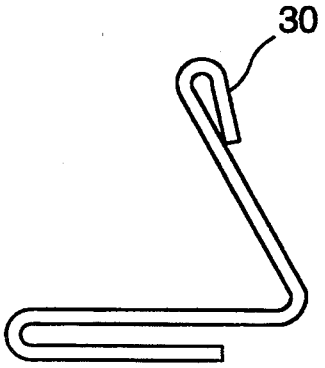
FIG. 4 is a single winder embodiment of the invention with an enhanced passive restraint configuration.

FIG. 4 is a single winder version of the device in which the uppermost portion of lever has been modified to provide a lateral extension 30 designed to enhance the stability of the passive restraint system and to facilitate gripping and winding the lever. It also is easier for disabled persons to handle and less expensive to manufacture.

Although the prior art discloses a number of tube winder devices, the present invention has advantages which in combination are significant improvements over prior art devices.

The key element of this invention is the provision of a passive restraint function through the simple device of modifying the angle between the clasp and the lever.

The passive restrain embodiments of the device are useful in all applications, but are especially useful in connection with the new stand-up collapsible tubes. The heavy gage plastic which is commonly used in stand-up tubes has a greater tendency to unwind than the thinner material used in prior tubes. Thus the passive restraint is essential to the practical application of this device to such tubes.

Most collapsible dispensers have a sealed flat base end with a round tube configuration extending from the base. Generally the diameter of the round section is approximately $\frac{3}{4}$ of the width of the base. Referring to a typical configuration of a double winder embodiment, such as shown in FIG. 1, for purposes of discussion the portion of the device engaged to the base of the tube shall be referred to as the primary clasp, and the upright portion of the device which functions as the lever shall be referred to as the secondary clasp. The dimensions of a typical embodiment for use with a tube in which the diameter of the round section is approximately $\frac{3}{4}$ of the width of the base of the tube are generally as follows.

The longer legs of the primary clasp and the secondary clasp are substantially equal in length.

The shorter leg of the primary clasp is approximately $\frac{3}{4}$ of the length of the longer leg of the primary clasp, and the shorter leg of the secondary clasp is approximately $\frac{3}{4}$ of the length of the shorter leg of the primary clasp. The interior angle between the primary clasp and the secondary clasp is approximately 60 degrees and is dependent upon the width of the bottom seal of the tube and the diameter of the filled portion of the tube. The exact angle will be readily apparent to those fabricating a winder for a particular application.

The interior angle should insure that the uppermost end of the secondary clasp intercepts the round filled portion of the tube by at least $\frac{1}{8}$ inch.

The restraining feature of the passive restraint embodiment is dependent upon a ratchet effect between the top of the lever and the reverse side of the rounded portion of the tube. When tile tube is wound on the clasp, the clasp is held firmly from side-ways movement and the restraining effect accomplished without any adjustment of the clasp. The rounded configuration of the portion of the clasp which restrains the tube also prevents the clasp from puncturing the tube.

The device of this invention is particularly useful with heavy gauge plastic tubes with heavy viscous contents, as they tend to involuntarily unwind during the first stages of winding.

The device as shown and described is fabricated from wire rod. It is obvious that it may be fabricated from other materials such as plastic, non-ferrous metals, and polymer coated metals. The selection of such materials is within the skill of the art.

In the device as shown all elements of the device are located within the same plane. However, the unconnected parallel member of the clasp functioning as a clasp, may be rotated 360 degrees around the connected parallel member and all such configurations are within the scope of the invention. The configuration in which the unconnected parallel member of the clasp functioning as a clasp is located within the same plane as the clasp functioning as a winder, but is located above the parallel member which is connected to the winder, will not permit the engagement or disengagement of the tube from the side, however with that exception the device will operate as described herein in all such configurations.

The description above is not intended to limit the scope of the invention, but rather to provide illustrations of different embodiments. Adaptations within the scope of the invention will be apparent to those skilled in the art. The invention is to be accorded the broadest interpretation so as to encompass all such modifications and equivalent structures.

I claim:

1. A device for progressively advancing the contents of a collapsible tube from a closed bottom toward a user openable dispenser top to dispense the contents of said tube and for winding the spent portion of said tube, said device comprising:

(a) a one-piece angled rod, having an upright portion and a base portion, the interior angle between said upright portion and said base portion being less than 90 degrees;

(b) said upright portion configured to form a first clasp and said base portion configured to form a second clasp, both clasps consisting of a pair of parallel members spaced apart a distance sufficient to permit the insertion of the closed end of a collapsible tube;

(c) each pair of parallel members formed in a U-shape being connected to each other distal to the other pair of parallel members, and having an unconnected free leg proximate to said other pair of parallel members to define an opening proximate to said other pair of parallel members, whereby either of said pairs of parallel members may function as a base portion as the other pair functions as an upright portion and the closed bottom of a collapsible tube may be inserted between the parallel members of said base portion and said upright portion rotated to wind the spent portion of said tube upon the parallel members of said base portion and to force the tube contents toward the dispenser portion of said tube and whereby the angle between said upright portion and said base portion permits said upright portion to pass behind said collapsible tube and passively restrain it from unwinding.

2. A device according to claim 1, in which the length of the unconnected free leg of each pair of parallel members differs to accommodate tubes of different widths.

3. A device according to claim 1, in which the unconnected free leg of said upright portion configured to form a first clasp is bent toward said connected member and in the same plane to enhance its function as a winder and is spaced apart from said connected member a distance sufficient to permit the insertion of the closed end of a collapsible tube.

4. A device according to claim 1, in which each unconnected free leg of said clasps is bent toward its respective connected member and in the same plane to enhance its function as a winder and is spaced apart from said connected member a distance sufficient to permit the insertion of the closed end of a collapsible tube.

5. A device for progressively advancing the contents of a collapsible tube from a closed bottom toward a user openable dispenser top to dispense the contents of said tube and for winding the spent portion of said tube, said device comprising:

(a) a one-piece angled rod, having an upright portion and a base portion, the interior angle between said upright portion and said base portion being less than 90 degrees;

(b) the upright portion of said angled rod being a lever;

(c) the base portion of said angled rod configured to form a clasp;

(d) said clasp consisting of a pair of parallel members spaced apart a distance sufficient to permit the insertion of the closed end of a collapsible tube;

(e) said parallel members forming a U-shape being connected to each other distal to said lever, one of said parallel members being connected to said lever and the other parallel member being unconnected proximate to said lever and defining an opening proximate to said lever, said opening proximate to said lever spaced apart from said lever to permit the insertion and removal of a partially wound tube;

whereby the closed bottom of a collapsible tube may be inserted between said parallel members and said lever rotated to wind the spent portion of said tube upon said parallel members and to force the tube contents toward the dispenser portion of said tube and whereby the angle between said lever and said clasp winder permits the upper portion of said lever to pass behind said collapsible tube and passively restrain it from unwinding.

6. A device according to claim 5 in which the upper portion of said upright portion is formed into a curved loop extending from said upright portion in a direction away from said tube to enhance gripping the upright portion and winding said tube.

7. A device according to claim 5 in which the upper portion of said upright portion is formed into a shape for enhanced gripping by the user said shape extending from said upright portion in a direction away from said tube to enhance gripping the upright portion and winding said tube.

* * * * *